US008769955B2

(12) United States Patent
Van Nieuwenhuizen et al.

(10) Patent No.: US 8,769,955 B2
(45) Date of Patent: Jul. 8, 2014

(54) SELF-REGULATING FUEL STAGING PORT FOR TURBINE COMBUSTOR

(75) Inventors: William F. Van Nieuwenhuizen, Paris (CA); Timothy A. Fox, Hamilton (CA); Steven Williams, Burlington (CA)

(73) Assignee: Siemens Energy, Inc., Orlando, FL (US)

( * ) Notice: Subject to any disclaimer, the term of this patent is extended or adjusted under 35 U.S.C. 154(b) by 1013 days.

(21) Appl. No.: 12/791,975

(22) Filed: Jun. 2, 2010

(65) Prior Publication Data

US 2011/0296839 A1 Dec. 8, 2011

(51) Int. Cl.
*F02C 1/00* (2006.01)
*F02G 3/00* (2006.01)

(52) U.S. Cl.
USPC ..... 60/740; 60/737; 60/748; 60/749

(58) Field of Classification Search
USPC ..... 60/732, 737, 738, 740, 748, 749
See application file for complete search history.

(56) References Cited

U.S. PATENT DOCUMENTS

| | | | | |
|---|---|---|---|---|
| 3,691,761 | A | 9/1972 | Jackson et al. | |
| 3,930,368 | A | 1/1976 | Anderson et al. | |
| 3,973,390 | A * | 8/1976 | Jeroszko | 60/776 |
| 4,112,676 | A | 9/1978 | DeCorso | |
| 4,910,957 | A | 3/1990 | Moreno et al. | |
| 4,928,481 | A * | 5/1990 | Joshi et al. | 60/737 |
| 4,944,149 | A | 7/1990 | Kuwata | |
| 5,239,818 | A | 8/1993 | Stickles et al. | |
| 5,357,745 | A | 10/1994 | Probert | |
| 5,479,781 | A * | 1/1996 | Fric et al. | 60/740 |
| 6,047,550 | A | 4/2000 | Beebe | |
| 6,415,610 | B1 * | 7/2002 | Parker | 60/798 |
| 6,609,376 | B2 * | 8/2003 | Rokke | 60/748 |
| 6,722,133 | B2 | 4/2004 | Inoue et al. | |
| 7,373,772 | B2 | 5/2008 | Simons et al. | |
| 7,437,876 | B2 * | 10/2008 | Koshoffer | 60/761 |
| 7,603,841 | B2 | 10/2009 | Steele et al. | |
| 7,631,499 | B2 | 12/2009 | Bland | |
| 2009/0019855 | A1 | 1/2009 | Venkataraman et al. | |
| 2011/0067402 | A1 | 3/2011 | Wiebe et al. | |

FOREIGN PATENT DOCUMENTS

| | | |
|---|---|---|
| EP | 2236938 A2 | 10/2010 |
| EP | 2458284 A2 | 5/2012 |

* cited by examiner

*Primary Examiner* — Ehud Gartenberg
*Assistant Examiner* — Karthik Subramanian

(57) ABSTRACT

A port (60) for axially staging fuel and air into a combustion gas flow path 28 of a turbine combustor (10A). A port enclosure (63) forms an air path through a combustor wall (30). Fuel injectors (64) in the enclosure provide convergent fuel streams (72) that oppose each other, thus converting velocity pressure to static pressure. This forms a flow stagnation zone (74) that acts as a valve on airflow (40, 41) through the port, in which the air outflow (41) is inversely proportion to the fuel flow (25). The fuel flow rate is controlled (65) in proportion to engine load. At high loads, more fuel and less air flow through the port, making more air available to the premixing assemblies (36).

15 Claims, 4 Drawing Sheets

SELF-REGULATING FUEL STAGING PORT FOR TURBINE COMBUSTOR

STATEMENT REGARDING FEDERALLY SPONSORED DEVELOPMENT

Development for this invention was supported in part by Contract No. DE-FC26-05NT42644, awarded by the United States Department of Energy. Accordingly, the United States Government may have certain rights in this invention.

FIELD OF THE INVENTION

This invention relates to axial staging of fuel and air into gas turbine combustors for efficiency and reduction of nitrogen oxides and carbon monoxide emissions.

BACKGROUND OF THE INVENTION

Gas turbine combustors have used axially staged fuel injection to reduce NOx (nitrogen oxides) and CO (carbon monoxide) emissions. NOx emissions increase with combustion temperature and residence time. For this reason, Dry Low NOx (DLN) combustors premix fuel and air to reduce peak combustion temperature. However, CO emissions increase as the combustion becomes cooler or residence time is reduced. This means that, in general, reducing CO emissions results in an increase in NOx and vice versa, making it difficult to reduce both forms of emissions simultaneously. It has been found beneficial to reduce airflow to the primary combustion zone during low-load operation to simultaneously maintain acceptable emissions of both CO and NOx. Prior methods for reducing this airflow include variable inlet vanes on the compressor that control total airflow, and compressor bleeds that divert air around the combustion system.

BRIEF DESCRIPTION OF THE DRAWINGS

The invention is explained in the following description in view of the drawings that show.

DETAILED DESCRIPTION OF THE INVENTION

Figure 1:
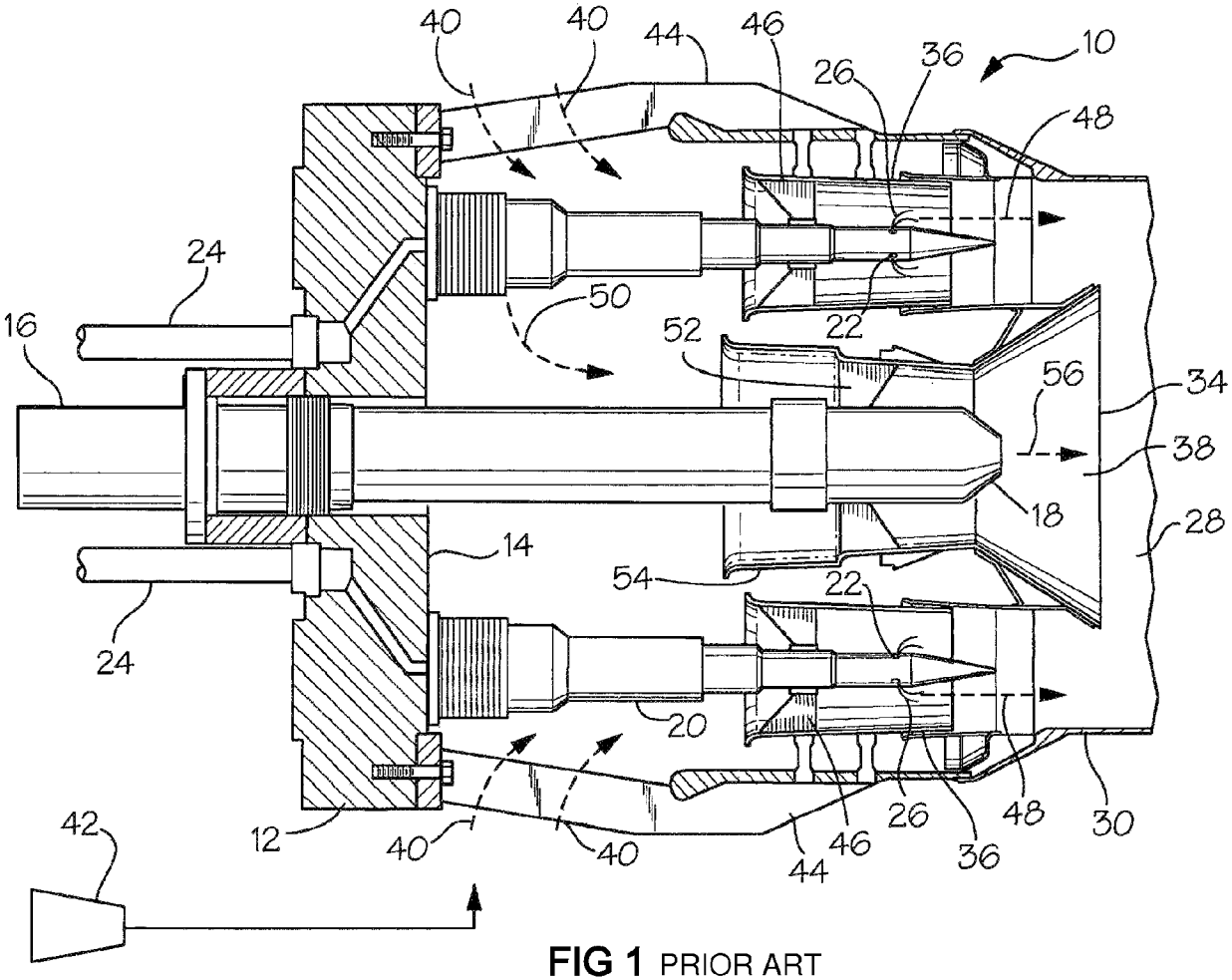
FIG 1 PRIOR ART
FIG. 1 is a sectional side view of a prior art gas turbine combustor.

FIG. 1 shows an example of a prior art gas turbine combustor 10. Support ribs 44 are attached to a surface 14 of a base 12. Fuel lines 24 supply injection ports 22 of delivery structures 20 in premixing assemblies 36, which may include swirlers 46 for mixing of fuel and air. A combustion chamber 28 is enclosed by a basket 30. A pilot fuel line 16 may supply a pilot fuel injection nozzle 18 in a skirt 34 that shields a pilot flame zone 38. Compressed air 40 from the turbine compressor 42 flows between the support ribs 44 and through the premixing assemblies 36. The swirlers 46 create air turbulence that mixes the compressed air 40 with fuel 26 to form a fuel/air premix 48, which burns in the combustion chamber 28. A portion 50 of the compressed air enters the pilot flame zone 38 between supports or vanes 52 in a pilot assembly 54. This figure is not intended to limit the present invention.

Figure 2:
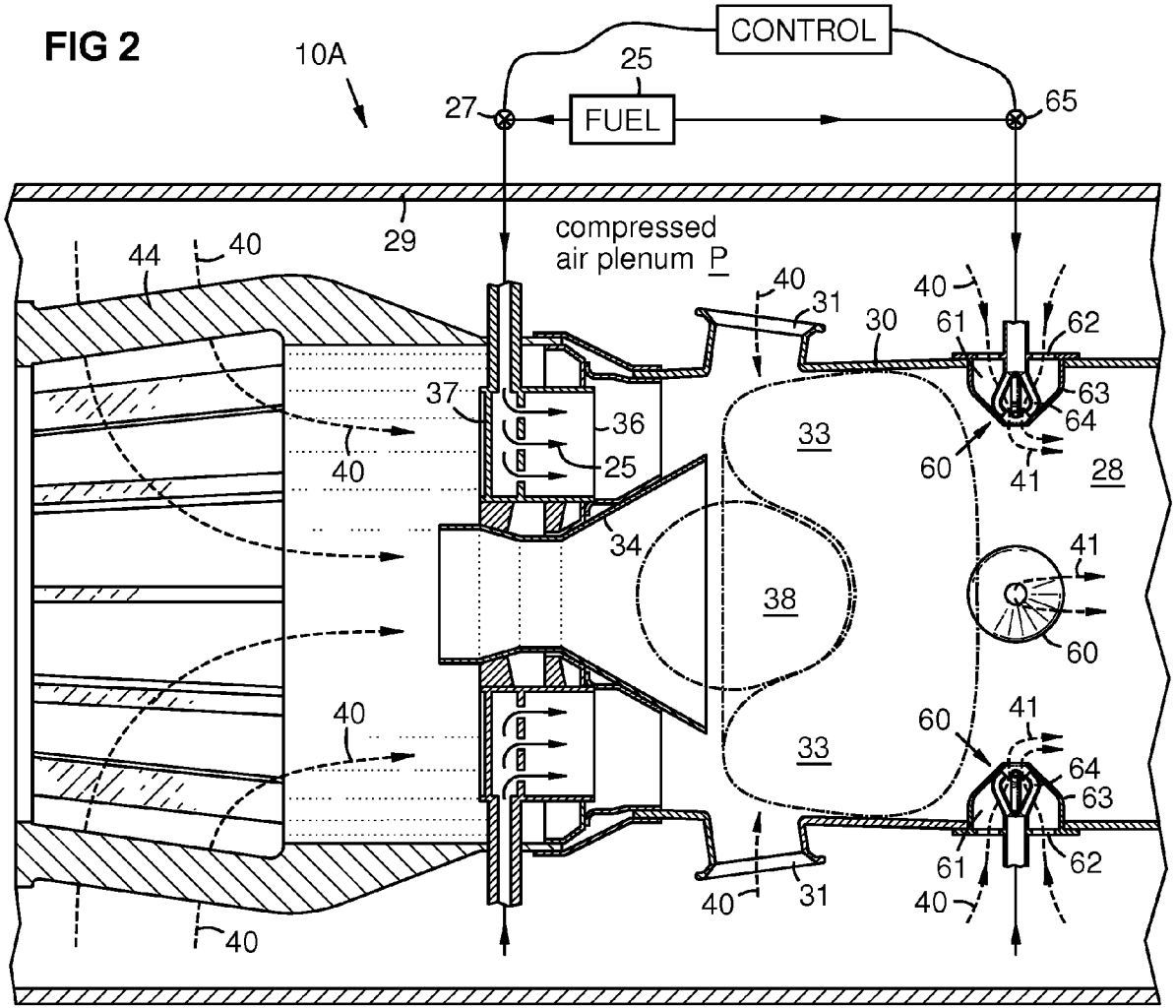
FIG. 2 is a sectional side view of a gas turbine combustor with a staging port according to aspects of the present invention.

FIG. 2 illustrates a gas turbine combustor 10A with a case 29 around a basket 30 supported by ribs 44. The turbine compressor supplies compressed air 40 to a plenum P between the basket 30 and the case 29. Fuel 25 flows via a primary fuel control valve 27 to premix injectors 37 in an annular array of premixing assemblies 36 around a skirt 34 that may surround a pilot assembly (not shown) and portions of a pilot flame zone 38. A primary combustion zone 33 is fueled by the premix injectors 37, and occupies an upstream portion of the combustion gas flow path. Various air inlet ports may be provided in the basket 30 for mixing, film cooling, and dilution. Exemplary air inlet ports 31 are shown.

Axial fuel/air staging ports 60 according to aspects of the invention may be mounted in the wall of the combustor basket 30 as shown, and/or further downstream in a transition piece or intermediate duct, to add air/fuel into the combustion gas path within or downstream of the primary combustion zone. A port enclosure 63 forms a port chamber 61 that provides an airflow path 40, 41 from air openings 62 that admit air from the plenum P to pass through the port chamber 61 and into the combustion chamber 28. Air in the plenum P is maintained at a higher pressure than the combustion gases, thereby driving the air flow through the chamber 61. Convergent fuel injectors 64 in the staging port 60 are supplied with fuel 25 via a staging port control valve 65.

Figure 3:
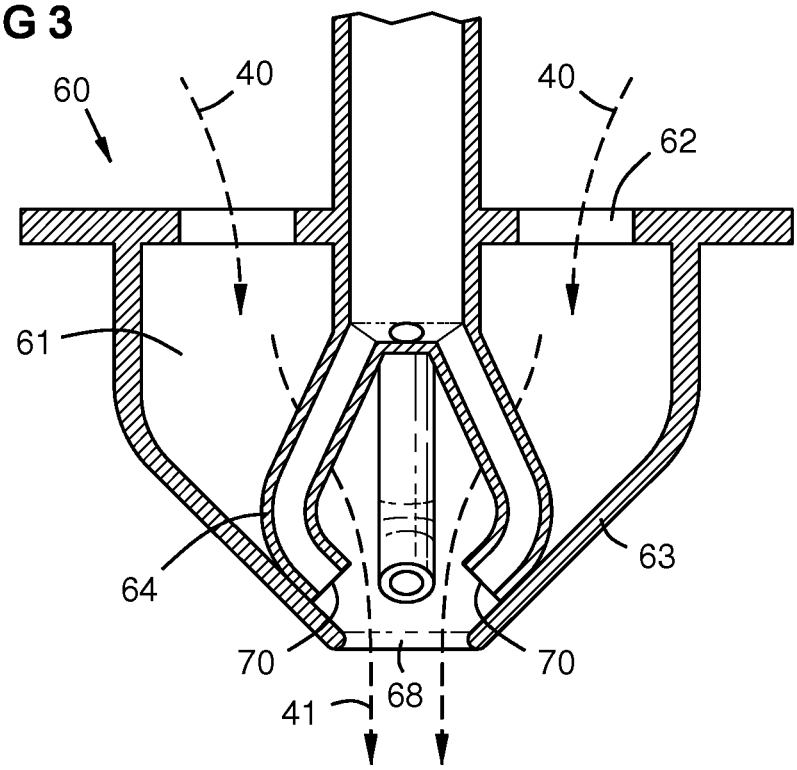
FIG. 3 is a sectional view of a staging port according to aspects of the invention.

FIG. 3 is an enlarged sectional view of a staging port 60, showing the port chamber 61 formed by the port enclosure 63. Convergent injectors 64 are mounted in the chamber 61. An exit hole 68 may be positioned about or beyond a point of fuel flow convergence between the outlets 70 of the injectors. When fuel is not supplied, air 40 enters the openings 62 and passes through the chamber 61 between and/or around the injectors 64, and flows out 41 the exit hole 68.

Figure 4:
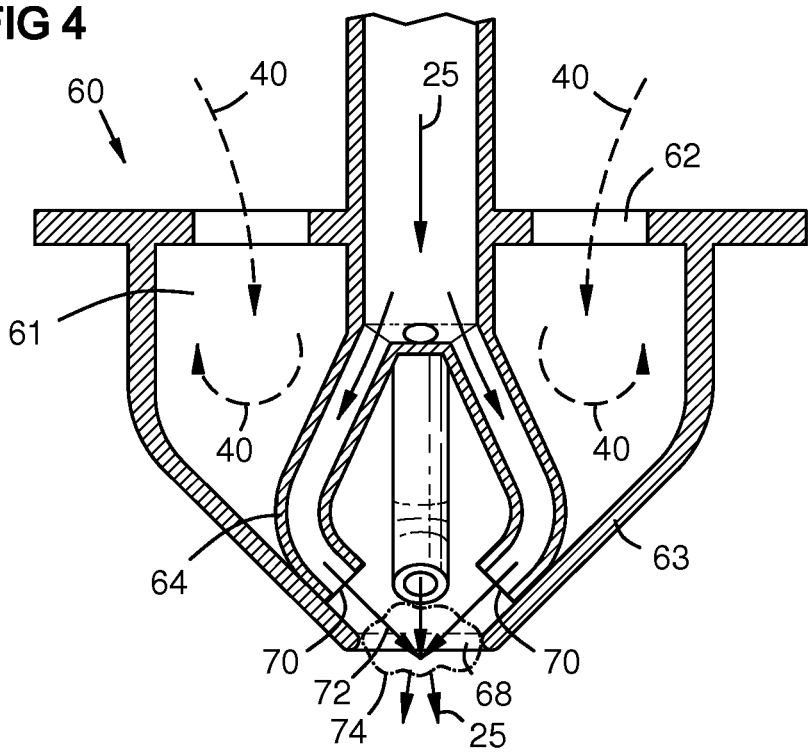
FIG. 4 is a view as in FIG. 3 when fuel is supplied to the staging port.

FIG. 4 shows the staging port 60 of FIG. 3 when fuel 25 is supplied to the injectors 64. Fuel streams 72 converge to oppose each other and form a relative higher pressure stagnation zone 74 that reduces the airflow 40 through the port chamber 61 in proportion to the flow rate of the streams 72. Where the fuel streams 72 meet and slow, velocity pressures of the fuel streams 72 are converted to static pressure, forming the flow stagnation zone 74. The amount of air passing through the port 60 is inversely proportional to the fuel flow. No moving mechanical part exists in the port, however, the stagnation zone 74 acts as a valve. In an illustrated embodiment the air flow 40 is not completely stopped even at a maximum flow rate of the streams 72 so that a fuel/air mixture exits the port 60 into the combustion chamber 28. In one embodiment the air flow rate at maximum gaseous fuel flow rate is reduced to 20% of the air flow rate when no gaseous fuel is supplied through the port.

Figure 5:
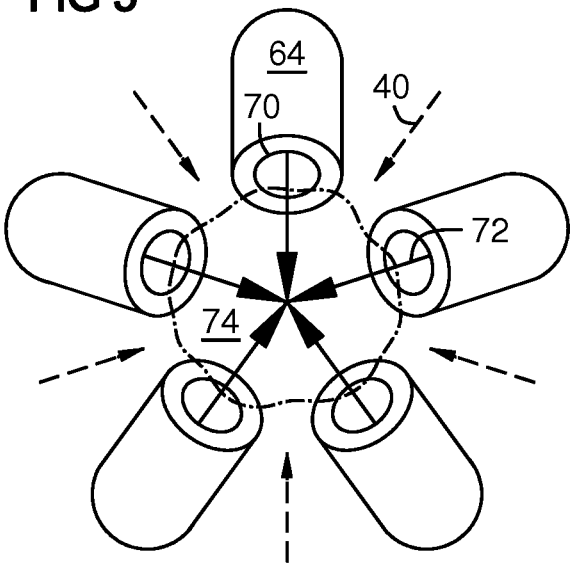
FIG. 5 is a view of convergent injectors as seen from the exit end of the port.

FIG. 5 is a view of five convergent injectors 64 providing convergent fuel streams 72 that create a stagnation zone 74 that blocks air flow 40. Two or more injectors 64 may be used, especially 3 or more such that each converging fuel stream 72 is both opposed and pinched by others of the converging fuel streams 72. Each of the fuel streams 72 may be partly angled toward the exit hole 68 in a conical convergence geometry that turns each of the fuel streams 72 toward the exit hole and into the combustion gas flow path.

The arrangement illustrated in FIGS. 2-5 may be used advantageously to reduce both NOx and CO emissions. This is accomplished by varying the rate of fuel flow through the port 60 as the power level of the combustor 10A is changed. At relatively lower power levels, there tends to be an excess of air flowing through the premixing assemblies 36, thus making the primary combustion zone 33 overly lean and increasing the CO emissions. This tendency is counteracted in the arrangement of FIGS. 2-5 by controlling valve 65 to supply little or no fuel to the port 60 during partial load operation, thereby maximizing the amount of air 40 that bypasses the premixing assemblies 36. This tends to make the primary combustion zone 33 somewhat richer than it otherwise would be without such bypassing air flow, thereby lowering CO emissions.

As the percentage of full load power output increases, however, the energy input has to increase and the amount of fuel entering the combustion system must increase. As the temperature in the primary combustion zone 33 increases, NOx emissions also increase and CO emissions generally decrease. It now becomes advantageous to redistribute the fuel injection to reduce the peak firing temperatures in the primary combustion zone 33. The arrangement of FIGS. 2-5 allows the ports 60 to be used for adding fuel downstream of the primary combustion zone 33 when operating at higher power levels. At higher engine loads, the staging port fuel valve 65 is controlled to increase fuel flow to the port 60. This not only adds fuel to the combustor 10A, but it also increases the airflow 40 through the premix injectors 37 and/or through other air mixing ports 31 into the primary combustion zone 33, thus making the primary combustion leaner and reducing peak combustion temperatures to reduce NOx emissions. This occurs because the stagnation zone 74 blocks or reduces air outflow 41 from the staging ports 60, thus increasing pressure in the plenum P by adding backpressure, although such a pressure increase may be very small and probably not quantifiable due to the normal pressure fluctuations in this region resulting from combustion noise. No moving part is required to yield this inverse air to fuel relationship, since as the fuel flow 72 is increased, the air flow 40 through the chamber 61 is resultantly decreased.

This invention extends the range of acceptable CO and NOx emissions on both low and high ends of a total fuel to total air spectrum. It is not limited to a particular type of combustor. Can-annular combustors are shown. Annular combustors may also incorporate these staging ports 60 into a wall of the combustion gas flow path.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A gas turbine engine combustor comprising a fuel staging port in a wall surrounding a combustion gas flow path, the fuel staging port comprising:

a port enclosure defining an airflow path from an air opening that admits air from outside the wall to an exit hole in fluid communication with the combustion gas flow path; and fuel injectors in the port enclosure that provide a convergent fuel flow that forms a flow stagnation zone;

wherein the fuel injectors are positioned to locate the flow stagnation zone such that it is effective as a valve in the airflow path, admitting an airflow through the port enclosure inversely to a rate of the convergent fuel flow.

2. The gas turbine engine combustor as in claim 1, further comprising at least three fuel injectors providing a convergent plurality of fuel streams wherein each of the fuel streams is opposed by others of the fuel streams, slowing the fuel streams and forming the stagnation zone.

3. The gas turbine engine combustor as in claim 2, wherein each of the fuel injectors is partially angled toward the exit hole in a conical convergence geometry that turns the fuel streams toward the exit hole.

4. The gas turbine engine combustor as in claim 1, wherein the wall forms a basket of a gas turbine combustor.

5. The gas turbine engine combustor as in claim 4, further comprising a compressed air plenum around the basket and a fuel control that increases the convergent fuel flow in proportion to a load of the gas turbine engine, wherein the airflow through the fuel staging port is reduced at increased engine loads, making more compressed air available via the plenum to a premixing assembly in the combustion gas flow path.

6. A gas turbine engine combustor comprising:

a premixing assembly delivering a fuel/air mixture to a combustion zone;

a bypass flow path effective to deliver a bypass air flow around the premixing assembly to the combustion zone; and a fuel element disposed in the bypass flow path and comprising a geometry effective to at least partially block the bypass air flow in proportion to a flow rate of fuel delivered through the fuel element.

7. The gas turbine engine combustor as in claim 6, wherein the bypass flow path comprises a port formed in a wall defining the combustion zone, the fuel element being disposed within the port.

8. The gas turbine engine combustor as in claim 7, wherein the fuel element comprises a plurality of fuel injectors providing convergent fuel flows effective to create a flow stagnation zone within the port to at least partially block the bypass air flow in proportion to the flow rate of fuel delivered through the fuel element without any moving mechanical part within the port.

9. The gas turbine engine combustor as in claim 8, comprising at least 3 fuel injectors, wherein the fuel streams are partly angled toward an exit hole in the port via a conical convergence geometry that turns each of the fuel streams toward the exit hole and into the combustion zone.

10. The gas turbine engine combustor as in claim 8, further comprising a fuel control that increases the convergent fuel flows in proportion to a load of the gas turbine engine combustor, wherein the bypass air flow through the port is reduced at increased engine loads, making more compressed air available to the premixing assembly.

11. A gas turbine engine combustor comprising a combustion zone surrounded by a wall, a compressed air plenum surrounding the wall, and characterized by:

a fuel and air staging port mounted in the wall, comprising:

a port enclosure that receives compressed air at a first end open to the plenum, wherein the compressed air flows through an interior path in the port enclosure and exits an exit hole to the combustion zone at a second end of the port enclosure; and a plurality of convergent fuel injectors in the port enclosure that direct respective convergent fuel streams forming a flow stagnation zone proximate the second end of the port enclosure that at least partially blocks the flow of compressed air through the port enclosure in proportion to a flow rate of the convergent fuel streams;

wherein the flow rate of the convergent fuel streams inversely determines a flow rate of the compressed air through the port enclosure and the exit hole.

12. A gas turbine engine combustor as in claim 11, wherein the convergent fuel injectors provide a convergent plurality of fuel streams, and each of the fuel streams is opposed by the others of the fuel streams, thus slowing each of the fuel streams and converting a velocity pressure of each fuel stream to a static pressure, forming the stagnation zone.

13. A gas turbine engine combustor as in claim 12, wherein each of the fuel injectors is partly angled toward the exit hole in a conical convergence geometry that turns the fuel stream toward the exit hole and into the combustion gas flow path.

14. A gas turbine engine combustor as in claim 11, wherein the wall forms a basket of a gas turbine combustor.

15. A gas turbine engine combustor as in claim 14, further comprising a case around the basket forming the compressed air plenum between the case and the basket, and a fuel control mechanism outside the case that increases the convergent fuel flows in proportion to a load of the gas turbine engine, decreasing the flow of compressed air through the port enclosure.

* * * * *